US005220237A

United States Patent [19]

Maseki et al.

[11] Patent Number: 5,220,237

[45] Date of Patent: Jun. 15, 1993

[54] METAL HALIDE LAMP APPARATUS

[75] Inventors: Kyoichi Maseki, Gyoda; Kazutoshi Kurosawa, Kisaimachi; Akira Urushihara, Fukaya, all of Japan

[73] Assignee: Iwasaki Electric Co., Ltd., Tokyo, Japan

[21] Appl. No.: 698,225

[22] Filed: May 10, 1991

[30] Foreign Application Priority Data

May 31, 1990 [JP] Japan ..... 2-139819
Nov. 2, 1990 [JP] Japan ..... 2-295461

[51] Int. Cl.[5] ..... H01J 5/16

[52] U.S. Cl. ..... 313/113; 313/114; 313/116; 313/606; 313/620; 313/635; 313/571

[58] Field of Search ..... 313/111, 112, 113, 114, 313/116, 606, 621, 634, 635, 626, 570, 571, 267

[56] References Cited

U.S. PATENT DOCUMENTS 2,084,999 6/1937 Birdseye ..... 313/116
2,714,687 8/1955 Issacs et al. ..... 313/620
4,171,948 10/1979 Fromm et al. ..... 313/116
4,249,102 2/1981 Krieg et al. ..... 313/633
4,803,394 2/1989 Holten ..... 313/114
4,988,918 1/1991 Mori et al. ..... 313/620

*Primary Examiner*—Palmer C. Demeo
*Assistant Examiner*—N. D. Patel
*Attorney, Agent, or Firm*—Armstrong, Westerman, Hattori, McLeland and Naughton

[57] ABSTRACT

A metal halide lamp apparatus includes a reflecting mirror and a metal halide lamp has a reflecting/thermal insulating film and a frost portion which is partially formed on the lamp outer surface within a predetermined range continued from the reflecting/thermal insulating film. This causes a decrease in an overall illuminance decrease and the attainment of a desired illuminance ratio and prevents the occurrence of irregularity in illuminance and color. In addition, since electrodes are asymmetrically disposed, it is possible to decrease the rate of devitrification of the luminous tube and make an attempt to increase the life of the luminous tube.

8 Claims, 9 Drawing Sheets

METAL HALIDE LAMP APPARATUS

BACKGROUND OF THE INVENTION

The present invention relates to a metal halide lamp apparatus, and particularly to a metal halide lamp apparatus which comprises a metal halide lamp and a reflecting mirror, which produces a luminous intensity distribution within an optically limited region and which is used as a relatively small image light source.

Conventional small metal halide lamp apparatuses each comprising a reflecting mirror and a metal halide lamp having a luminous tube absent an outer bulb, both of which are integrally or detachably combined, are characterized by good color rendering and high luminous efficiency. Thus, such lamp apparatuses are used as light sources for overhead projectors, overhead-type liquid crystal projectors, liquid crystal projection televisions, moving picture projectors and so on, and the apparatuses are increasingly popularized.

Halogen lamps are generally used as light sources for the above projectors because it is desired to use light sources having good color characteristics for the above projectors. However, although halogen lamps have good color characteristics, the luminous efficiency thereof is as low as about 30 lm/W. A high-watt lamp must be thus used for obtaining a large illuminance on a screen. However, the use of a high-watt lamp has the problems that the size of an apparatus is increased due to the treatment of the heat generated from the light source and that a large quantity of heat is generated and cannot be easily treated.

On the other hand, metal halide lamps have luminous efficiency higher than that of the halogen lamps. If at least dysprosium halide is enclosed in a luminous tube, and if a metal halide lamp is operated at an increased vapor pressure of the halide and a decreased arc temperature, the emission of light within the red region is increased, and a spectral distribution having good color characteristics is obtained.

In conventional metal halide lamps used in the above projectors, for example, with rated lamp power of 150 W, a substantially spherical luminous tube 101 having an electrode spacing of 5 mm, the maximum outer diameter $\phi$11 mm and the maximum inner diameter of $\phi$8.8 mm is used, as shown in FIG. 1. Mercury and 150 torr of argon serving as auxiliary starting gas are enclosed in the luminous tube 101 so that a predetermined lamp voltage is obtained, and dysprosium iodide, neodymium iodide and cesium iodide are enclosed in an amount of 0.5 mg relative to the inner volume of the luminous tube of 0.4 cc at a ratio by weight of 4:2:3 to form a metal halide lamp.

The luminous tube 101 configured as described above has both end wires which are respectively connected to a nickel lead wire 102 and a base 103. A reflecting mirror 104 made of hard glass and having a cold mirror film provided on the surface thereof is provided so as to surround the luminous tube 101 coaxially therewith. One end of the lead wire 102 is led to the outside of the reflecting mirror 104 and connected to a terminal 105 to form a metal halide lamp apparatus 111.

When the metal halide lamp apparatus 111 configured as described above is used as a light source for a liquid crystal projector, for example, the metal halide lamp apparatus 111 is vertically placed with the bottom up for projecting an image on a screen 115 through a total reflection mirror 112, a liquid crystal panel 113 and a projection lens 114, as shown in FIG. 2.

In conventional metal halide lamps used in the above-described optical devices, as shown in FIG. 1, a reflecting-heat insulating film 106 is formed in a portion of the outer surface of a lamp in the vicinity of the electrode placed on the open side of the reflecting mirror 104, the other portion of the lamp outer surface having a clear surface. When such a metal halide lamp is disposed in the reflecting mirror 104 so that the clear surface faces the bottom of the reflecting mirror 104, as shown in the drawing, and when the lamp is switched on, assuming that the luminous portion of the arc of the luminous tube 101 is placed at the center of the luminous tube 101, the light emitted from the luminous portion to the clear surface passes substantially straight therethrough, without being scattered by the clear surface.

When the lamp is projected on a screen having an aspect ratio of 3:4, as shown in FIG. 3, through a lens system, the straight light emitted from the metal halide lamp through the clear surface is reflected from a portion of the reflecting mirror near the lamp and reaches the screen through the lens system. A large quantity of straight light passes through the clear surface, substantially without being scattered, and a large quantity of light emitted to a portion of the reflecting mirror 104 near the luminous tube 101 is reflected from the portion because of the low eccentricity of the portion of the reflecting mirror. When an illuminance distribution along the line A—A' on the screen was measured, the illuminance in a portion near the center is extremely high, while the illuminance in the peripheral portion is extremely low, as shown by a curve in FIG. 4. If an illuminance ratio in respect to the illuminance measured at each of measurement points ① to ⑨ at the centers of the respective regions which are obtained by dividing the screen into 9 equal parts is expressed by the following equation:

$$\text{Illuminance ratio (\%)} = \frac{\text{Minimum illuminance value at measurement points ① to ⑨}}{\text{Illuminance value at center (illuminance value at measurement point ⑤)}} \times 100$$

when a metal halide lamp comprising a luminous tube most of which has a clear surface is used, the illuminance ratio is as low as about 10%.

It is considered on the basis of experience that the illuminance ratio is preferably 30% or more from the visual viewpoint. The use of a metal halide lamp most of which has a clear surface, as described above, has the problem that irregularity is produced in the illuminance on the screen due to a low illuminance ratio, resulting in an unpleasant feeling.

On the other hand, it is thought that a frost portion is formed over the whole surface of the luminous tube in order to remove the unpleasant feeling caused by the irregularity in illuminance. The frost portion is formed on the outer surface of the luminous tube by satin treatment, i.e., sand blast processing, in which glass breads are sprayed on the clear outer surface of the tube having the thus-obtained frost portion, as shown in FIG. 5, about half of the light 122 emitted from the luminous portion at the center of the luminous tube travels as straight light 123 from the frost portion 121, the remainder light traveling from the frost portion 121 as light 124 scattered in the vicinity of the straight light 123.

When the luminous tube 101 in which the frost portion 121 is formed in the whole surface thereof except the thermal insulating film 106 is disposed in the reflecting mirror for projecting light on a screen, the straight light 123 in an amount of about half of the emitted light is applied to a portion of the reflecting mirror, which has relatively large eccentricity, reflected therefrom and reaches the vicinity of the center of the screen. Only a small quantity of scattered light 124 reaches the vicinity of the center and the peripheral portion of the screen. When the illuminance distribution along the line A—A' on the screen is measured, a curve b shown by a dotted line in FIG. 4 is obtained. As seen from the measurement of illuminance, although the provision of the frost portion permits an increase in the illuminance ratio, there is the problem that a desired illuminance cannot be obtained at the center of the screen because of a decrease in the overall illuminance, and that a large quantity of light is uselessly scattered.

Conventional metal halide lamp apparatuses also have the following problems: When the vapor pressure of the enclosed metal halide is increased by increasing the temperature of the luminous tube wall in a metal halide lamp, good color characteristics are obtained. However, when the metal halide lamp is vertically disposed and used, if a bare luminous tube absent an outer bulb is used, the temperature difference between the upper and lower portions of the inner surface of the quartz container which forms the luminous tube is increased, as compared with the case of a luminous tube with an outer bulb. If a desired vapor pressure is obtained by increasing the temperature of the lower portion (coolest portion) of the luminous tube containing a melted enclosed filling to substantially the same temperature as that of a lamp with an outer bulb, therefore, the temperature of the upper portion of the inner surface of the quartz container is excessively increased. Particularly, in the case of a lamp in which dysprosium is enclosed for improving the color characteristics, devitrification occurs in the upper portion of the luminous tube in an early stage.

In this case, although the overall luminous flux is only slightly changed, the color temperature of the color characteristics is decreased due to the heat insulating effect caused by the devitrification, and the illuminance on the screen is further decreased due to an increase in scattering caused by the devitrification. There are thus the problems that the screen is darkened or discolored, and that the lamp voltage is further increased.

SUMMARY OF THE INVENTION

Accordingly, it is an object of the present invention to provide a novel metal halide lamp apparatus which has none of the above problems of conventional metal halide lamp apparatuses.

It is another object of the present invention to provide a metal halide lamp apparatus which provides optimum illuminance on a screen without producing irregularity in illuminance and color on the screen.

It is a further object of the present invention to provide a metal halide lamp apparatus with a long life which not only provides optimum illuminance on a screen without producing irregularity in illuminance and color on the screen but also prevents devitrification from being produced by dysprosium in the inner surface of a quartz container which forms a luminous tube.

In order to solve the above problems, in an aspect of the present invention, a metal halide lamp apparatus comprises a reflecting mirror having a parabolic or ellipsoidal reflecting surface, and a metal halide lamp absent an outer bulb disposed in front of the reflecting mirror so that the axis connecting both electrodes substantially agrees with the axis of the reflecting mirror, wherein the metal halide lamp has a reflecting-thermal insulating film which is formed on a portion of the lamp outer surface in the vicinity of the electrode placed on the open side of the reflecting mirror, and a frost portion which is formed in a portion of the lamp outer surface which has one end at the edge of the reflecting-thermal insulating film and the other end ranging from a position near the center between both electrodes to a position near the center of the coil of the electrode placed on the bottom side of the reflecting mirror.

In the invention, the frost portion is not formed over the whole outer surface of the lamp, but it is partially formed in a portion of the lamp outer surface which has one end at the edge of the reflecting-thermal insulating film and the other end ranging from a position near the center between both electrodes to a position near the center of the coil of the electrode placed on the bottom side of the reflecting mirror so that a decrease in the overall illuminance is decreased, and a desired level of illuminance at the center of a screen is obtained when light is projected on the screen. It is thus possible to decrease irregularity in illuminance by increasing the illuminance ratio to 30% or more and obtain a clear image by improving the average illuminance of the screen.

In another aspect of the present invention, a metal halide lamp apparatus comprises a reflecting mirror having a parabolic or ellipsoidal reflecting surface, and a metal halide lamp absent an outer bulb disposed in front of the reflecting mirror so that the axis connecting both electrodes substantially agrees with the axis of the reflecting mirror, the axis of the metal halide lamp being vertically disposed during use, wherein the metal halide lamp has a reflecting-thermal insulating film which is formed on a portion of the lamp outer surface in the vicinity of the electrode placed on the open side of the reflecting mirror, and a frost portion which is formed in a portion of the lamp outer surface which has one end at the edge of the reflecting-thermal insulating film and the other end ranging from a position near the center between both electrodes to a position near the center of the coil of the electrode placed on the bottom side of the reflecting mirror, and the electrode which is an upper electrode during lighting has a portion projecting from the inner wall of the luminous tube, a ratio of the length $L_u$ of the projecting portion to the length $L_d$ of the projecting portion of the lower electrode being set to a value within the range of $1.2 \leqq L_u/L_d \leqq 1.8$.

In this way, the partially formed frost portion has the function of decreasing the irregularity in illuminance and thus increasing the average illuminance. In addition, the electrode portions are asymmetrically disposed so that the difference between the temperature distributions in the upper and lower portions of the luminous tube is decreased even when a bare luminous tube absent an outer bulb is used. Even when a dysprosium halide is enclosed in a luminous tube for obtaining a light source having good color characteristics, therefore, the rate of devitrification caused by an increase in the temperature of the quartz luminous tube is decreased, and the upper side of the luminous tube having a large optical utilization factor can be sufficiently utilized during the life of the lamp. This permits a decrease in an illumination decrease, an increase in the factor of maintenance of the screen illuminance at a high level and increases in the life and the luminous efficiency of the lamp.

DETAILED DESCRIPTION OF PREFERRED EMBODIMENTS

A metal halide lamp apparatus according to a first embodiment of the present invention is described below with reference to FIGS. 6 and 7.

Figure 6:
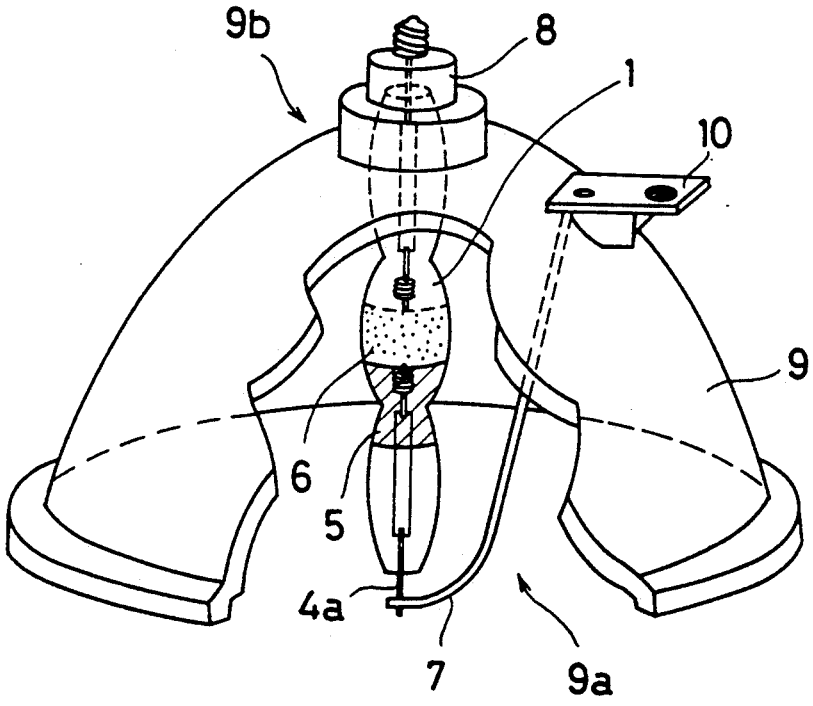
FIG. 6 is a partially broken-out side view of a metal halide lamp apparatus in accordance with an embodiment of the present invention.
Figure 7:
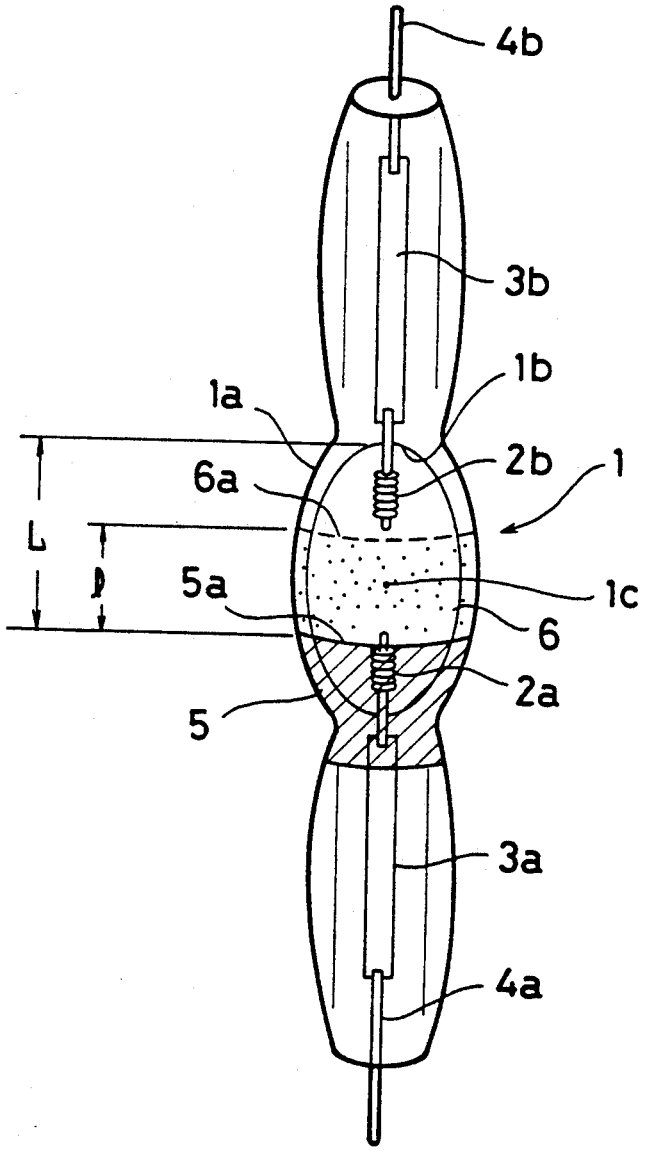
FIG. 7 is an enlarged side view of the luminous tube shown in FIG. 6.

FIG. 6 is a side view of a metal halide lamp apparatus with a partially broken-out reflecting mirror, and FIG. 7 is an enlarged side view of a metal halide lamp portion. In the drawings, reference numeral 1 denotes a luminous tube comprising a quartz container having the maximum outer diameter of 11 mm, the maximum inner diameter of 8.8 mm, content volume of 0.4 cc and an elliptical cross-sectional form. In the luminous tube 1, electrodes 2*a*, 2*b* are respectively provided at both ends of the luminous tube 1 at a distance of 5 mm. Each of the electrodes 2*a*, 2*b* has a closely wound coil which is formed by winding a tungsten wire having a diameter of 0.32 mm in a coil length of 2.5 mm on a tungsten core having a diameter of 0.45 mm and a length of 6.5 mm and containing $ThO_2$, the coil being disposed at a distance of 0.5 mm from the tip of the core.

Edged molybdenum foils 3*a*, 3*b* each of which has a width of 1.5 mm and a length of 12 mm and which are welded to the electrodes 2*a*, 2*b*, respectively, are provided in sealed portions for maintaining the airtightness in the luminous tube 1. Molybdenum wires 4*a*, 4*b* each having a diameter of 0.6 mm are connected to the other ends of the foils 3*a*, 3*b*, respectively, so that electric power is supplied from the outside through the wires 4*a*, 4*b*. In the luminous tube 1 are enclosed mercury, argon and 0.5 mg of three iodides, i.e:, dysprosium iodide, neodymium iodide and cesium iodide, at a ratio by weight of 4:2:3.

In addition, a reflecting-thermal insulating film 5 which has light reflection and heat resistance and which is made of a $Al_2O_3$-$SiO_2$ mixture or the like, is formed by coating on a portion of the outer surface of the lamp in the vicinity of the electrode 2*a* placed on the open side 9*a* of the reflecting mirror 9 described below. Further, a frost portion 6 is formed by frosting in a portion of the lamp outer surface within the range from the edge 5*a* of the thermal insulating film 5 to a position near the end of the electrode 2*b* placed on the bottom side 9*b* of the reflecting mirror 9 beyond a position corresponding to the center between both electrodes 2*a*, 2*b*.

The wires 4*a*, 4*b* of the luminous tube 1 configured as described above are respectively connected to a nickel lead wire 7 and a base 8, and the reflecting mirror 9 made of hard glass and having a cold mirror film on the inner surface thereof and $\phi$90 mm and f of 15 is provided so as to surround the luminous tube 1. In this case, the axis of the reflecting mirror 9 substantially lies on the axis of the luminous tube 1. One end of the lead wire 7 is led to the outside of the reflecting mirror 9 and connected to a terminal 10 to form a metal halide lamp apparatus.

When the metal halide lamp apparatus is switched on a rated power of 150 W by an electronic ballast using a rectangular wave of about 270 Hz, the lamp apparatus shows such luminous characteristics that the overall luminous flux is 12,000 lm, the color rendering index of Ra85, the color temperature is 7000K. and luminous efficiency is 80 lm/W, and has excellent characteristics as an image light source.

Figure 1:
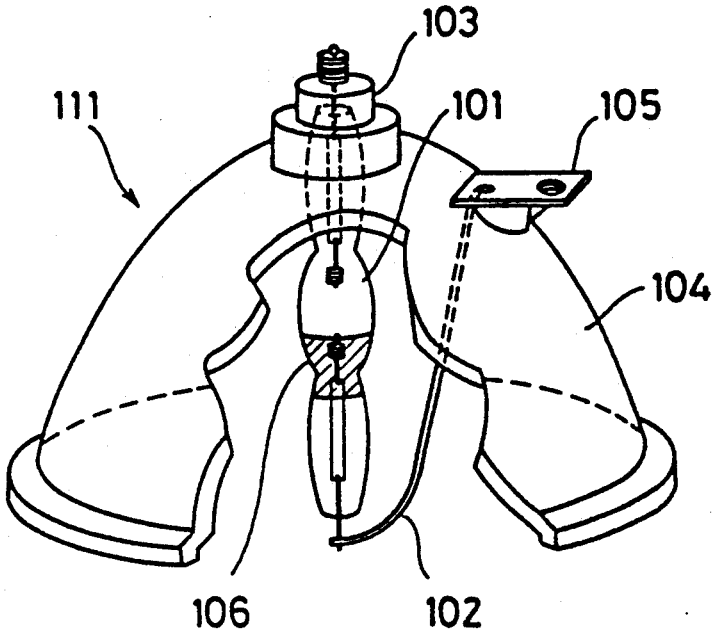
FIG. 1 PRIOR ART
FIG. 1 is a partially broken-out side view of a conventional metal halide lamp apparatus.
Figure 2:
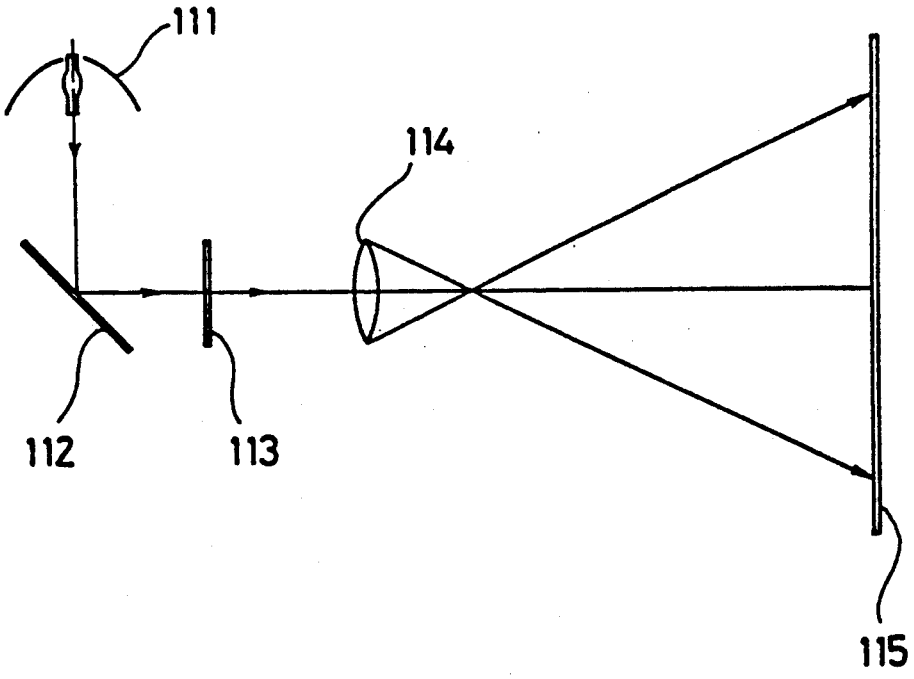
FIG. 2 is a schematic drawing of a liquid crystal projector which uses a metal halide lamp apparatus.
Figure 3:
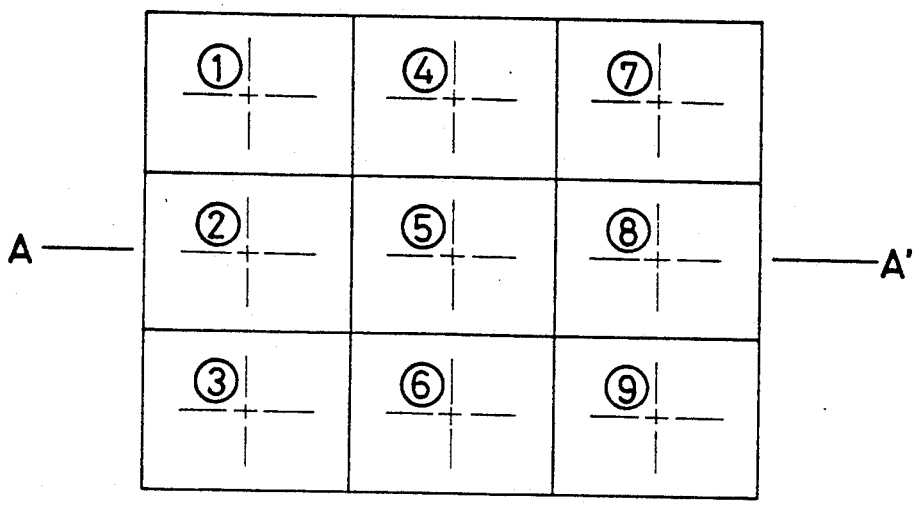
FIG. 3 is a drawing showing a screen used for measuring average illuminance and an illuminance ratio.
Figure 4:
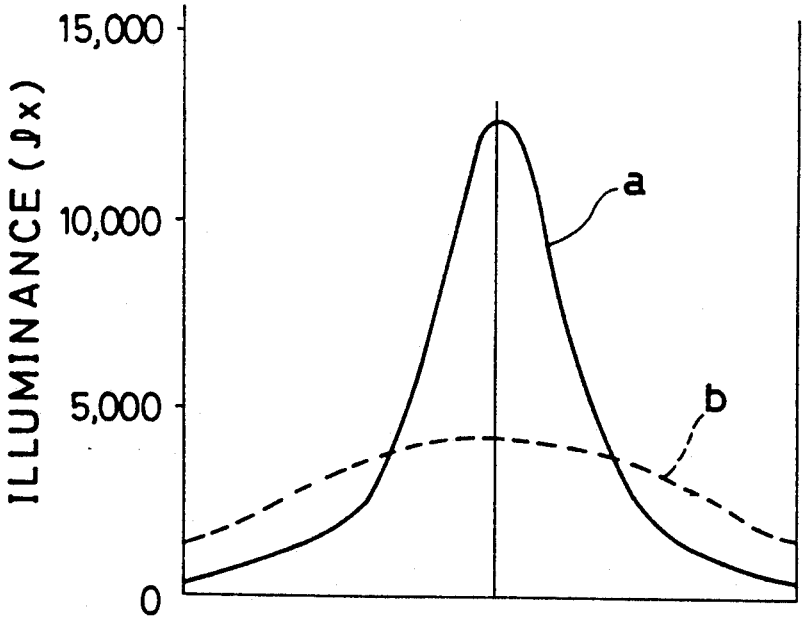
FIG. 4 is a drawing showing the illuminance distribution along the line A—A' on the screen shown in FIG. 3 when light is projected on the screen from a conventional metal halide lamp apparatus.
Figure 5:
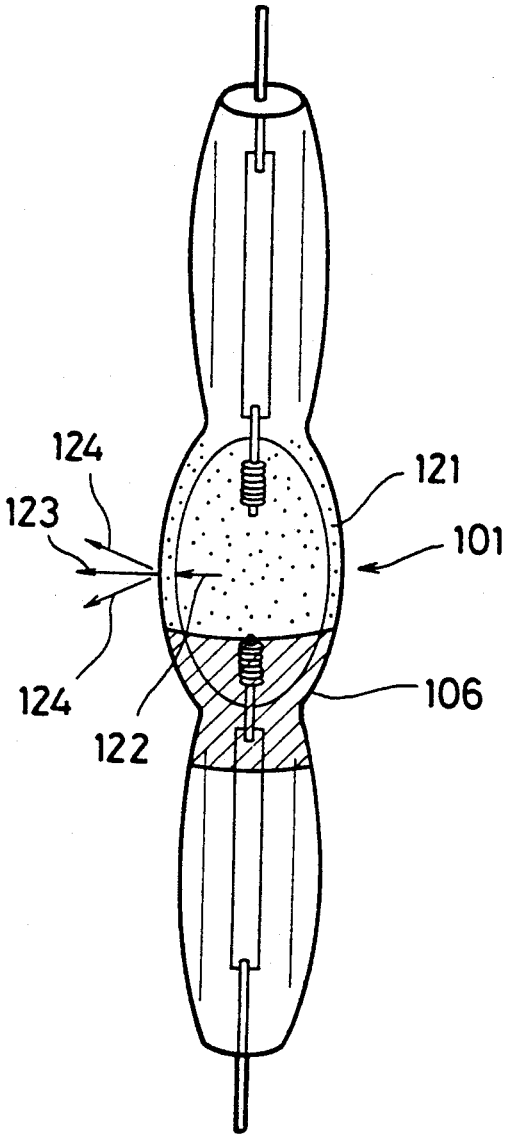
FIG. 5 is a drawing showing the state wherein light is emitted from a lamp having a frost portion formed over the whole outer surface of a luminous tube.
Figure 8:
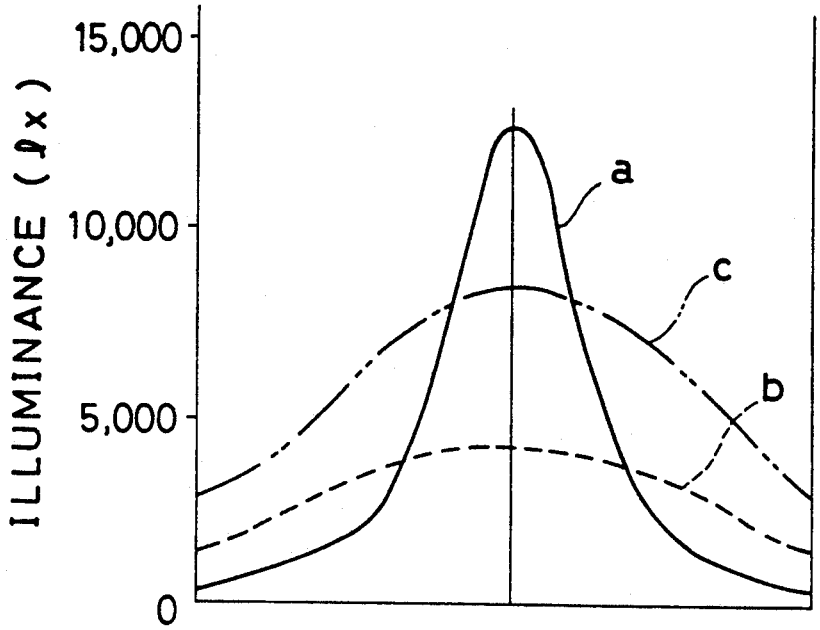
FIG. 8 is a drawing showing the illuminance distribution produced when light is projected on a screen from the metal halide lamp apparatus shown in FIG. 6.

When light was projected on the screen shown in FIG. 3 by a predetermined optical system, average illuminance of 4000 lx was obtained. In addition, when the illuminance distribution was measured along the line A—A' on the same screen, the illuminance characteristics shown by the curve c shown by a one-dot chain line in FIG. 8 were obtained, and the illuminance ratio was 30%, without producing irregularity in illuminance and color. In FIG. 8, the curves a, b shown in FIG. 4 are also shown for comparison.

Figure 9:
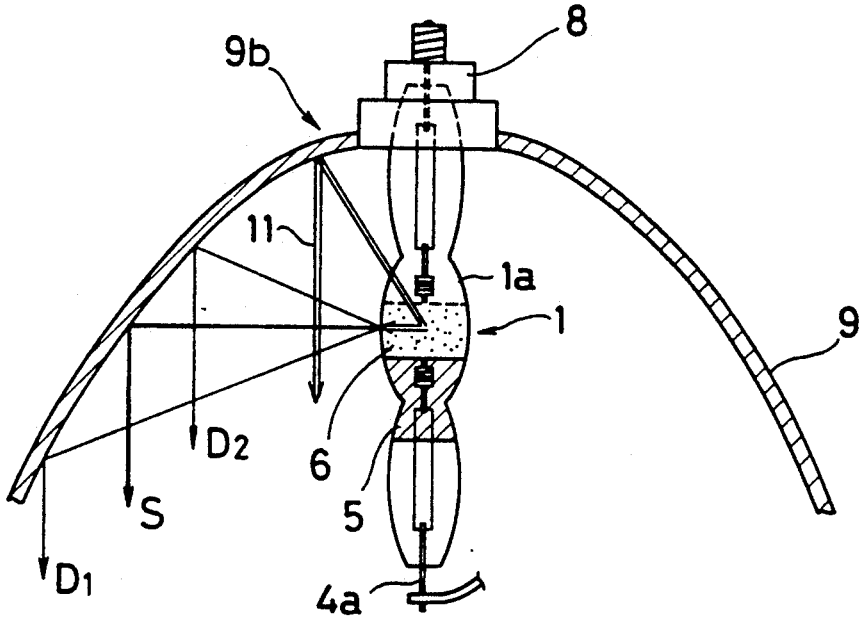
FIG. 9 is a drawing showing the paths of light emitted from the luminous tube shown in FIG. 6.

Reasons why the high average illuminance and appropriate illuminance ratio are obtained are the following: As shown in FIG. 9, the light 11 passing through the clear portion 1*a* on the bottom side 9*b* of the reflecting mirror 9 travels straight from the lamp surface without being scattered, is reflected from the reflecting mirror 9 and then projected on the central portion of the screen. Since the light passing through the clear portion 1*a* travels straight, without being scattered, as described above, the illuminance in the central portion on the screen is high.

On the other hand, about half of the light emitted toward the frost portion 6 passes through the frost portion 6 as it was and travels straight and, to some extent, it is applied to a portion away from the central portion on the screen. Rays of light $D_1$, $D_2$ scattered by the frost portion 6 are applied to the central or peripheral portion of the screen. This state where the light emitted from the luminous portion of the luminous tube 1 travels from the lamp surface in the above-described manner produces the illuminance distribution characteristics shown by the curve c shown by a one-dot line in FIG. 8.

In the present invention, the reflecting-thermal insulating film 5 is provided on a portion of the lamp surface in the vicinity of the electrode placed on the open side of the reflecting mirror of the lamp. The present invention thus has the functional effect described below. If such a reflecting-thermal insulating film 5 is not provided, much of the light emitted from the central luminous portion of the luminous tube 1 toward a region corresponding to a portion having the reflecting-thermal insulating film formed thereof travels in the direction in which it is not applied to the reflecting mirror. In an apparatus such as an overhead projector or the like, which uses such a metal halide lamp apparatus, therefore, stray light which does not reach the screen is produced. While, when the reflecting-thermal insulating film 5 is provided, as in the invention, the light emitted from the central luminous portion of the luminous tube 1 is irregularly reflected from the reflecting-thermal insulating film 5 and again returned to the central luminous portion so as to be effectively utilized, thereby increasing the luminous efficiency. In addition, since the vapor pressure of the substance enclosed in the lamp is increased due to the reflecting-thermal insulating film 5, the quantity of light is increased, and thus the luminous efficiency is further increased.

As described above, in the present invention, the frost portion 6 is partially formed over a predetermined range of the outer surface of the lamp. A description will now be given of the experiment performed for determining the optimum region for the formation of the first portion.

Figure 10:
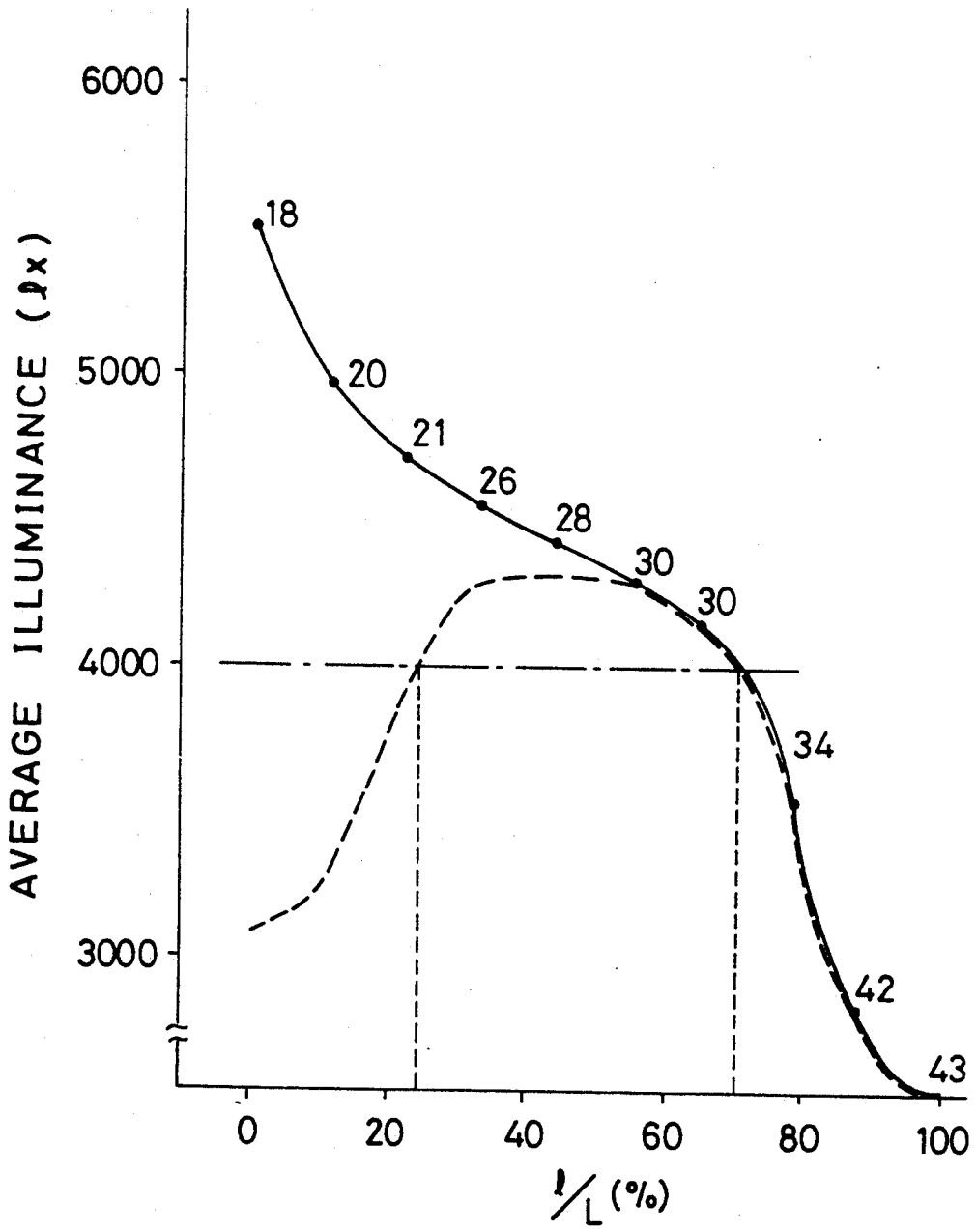
FIG. 10 is a drawing showing a relation between the ratio of the frost portion formed in the lamp outer surface and the average illuminance of a screen.

In the luminous tube 1 shown in FIG. 7, it is assumed that the length from the edge 5*a* of the reflecting-thermal insulating film 5 to the inner wall end 1*b* of the luminous tube 1 on the side of the electrode 2*b* is L, and the length from the edge 5*a* of the reflecting-thermal insulating film 5 to the end 6*a* of the frost portion 6 is l. Various lamps having different 1/L values, i.e., frost portions 6 having difference lengths, were prepared. The reflecting mirror 9 was then provided as shown in FIG. 6, and the average illuminance relative to each of the 1/L values was measured with constant lamp input of 150 W under the condition that the average illuminance of the measurements at the nine points on the screen was adjusted to the maximum. As a result, the results shown by the solid line in FIG. 10 were obtained. In FIG. 10, the abscissa shows the 1/L values (%), 0% shows a case where no frost portion was formed in the lamp outer surface, and 100% shows a case where the frost portion was formed over the whole outer surface of the lamp. The ordinate shows the average illuminance (1x) on the screen.

The average illuminance of the nine points on the screen in an average of the measured values obtained by measuring the illuminance in the central portions ① to 9 of the nine equal sections of the screen shown in FIG. 3. In FIG. 10, each of the values on the solid line represents the ratio or illuminance ratio of the minimum illuminance to the maximum illuminance on the screen, which illuminance ratio indicates the degree of irregularity in illuminance.

As seen from FIG. 10, comparison between the screen illuminance ratio shown at each of the plotted points on the solid line and the average illuminance reveals that when the 1/L value is about 10%, although the average illuminance is as high as about 5000 1x, the illuminance ratio is about 20%, and the irregularity in illuminance is large. It is also found that when the 1/L value is about 80%, although the illuminance ratio is increased to about 34%, the average illuminance is decreased to about 3500 1x.

A relation between the 1/L value and the average illuminance was then determined under the conditions that the illuminance ratio was kept at 30% because an illuminance ratio of 30% or more is visually required, and that the relative position between the lamp and the reflecting mirror was adjusted so that the average illuminance was the maximum. As a result, the results shown by the broken line in FIG. 10 were obtained.

As seen from the measurement curves shown by the solid and broken lines in FIG. 10, if the 1/L value which shows the ratio of the frost portion formed in the lamp outer surface is within the range from 25 to 70%, a good illuminance ratio of 30% or more and a good average illuminance of 4000 1x or more are obtained. Namely, the 1/L range permits a decrease in irregularity in illuminance on the screen, the formation of a bright image on the screen and the attainment of good optical characteristics.

When the 1/L value is less than 25%, for example, 20%, if the illuminance ratio is 30%, since the average illuminance is 3900 1x or less, the screen is darkened, and a good image cannot be thus obtained. While if an attempt is made to brighten the screen by increasing the average illuminance to 4000 1x or more, e.g., 4500 1x, since the illuminance ratio is decreased to about 24%, the irregularity in illuminance is remarkable. On the other hand, if the 1/L value exceeds 70%, the illuminance ratio is increased, and the irregularity in illuminance is decreased. However, for example, if the 1/L value is 80%, since the average illuminance is 3500 1x or less, the screen is darkened, and thus a good image cannot be obtained. If the 1/L value is less than 25% or over 70%, therefore, good optical characteristics are not obtained.

On the basis of the above measured values, a positional relation of the luminous portion of the luminous tube, the electrodes or the like to the optimum 1/L range from 25 to 70% for the frost portion formed in the lamp outer surface in the invention was examined. The results obtained were the following:

It was proved by the examination that a 1/L value of 25% corresponds to a case where the frost portion 6 is formed in a portion of the lamp outer surface within the range from the edge 5*a* of the reflecting-thermal insulating film 5 to substantially the center 1*c* (refer to FIG. 7) between the both electrodes. It was also provided that a 1/L value of 70% corresponds to a case where the frost portion 6 is formed in a portion of the lamp outer surface within the range from the edge 5*a* of the reflecting-thermal insulating film 5 to substantially the center of the coil of the electrode 2*b* placed on the bottom side of the reflecting mirror.

In the present invention, the range of the frost portion formed is therefore determined to a portion of the lamp outer surface which has one end at the edge of the reflecting-thermal insulating film and the other end ranging from a position near the center between both electrodes to a position near the center of the coil of the electrode placed on the bottom side of the reflecting mirror.

In the above first embodiment, the frost portion is partially formed so that the irregularity in illuminance is decreased, and the average illuminance on the screen is improved, as described above. In the metal halide lamp configured as described above, if an attempt is made to increase the temperature of the open side 9a (coolest portion) of the reflecting mirror 9 of the luminous tube 1 so that the color characteristics are improved by further increasing the vapor pressure of the enclosed metal halide, the temperature of a portion in the inner surface of the luminous tube 1 on the bottom side 9b of the reflecting mirror is significantly increased. In a lamp in which dysprosium is enclosed, because devitrification occurs in the quartz container which forms the luminous tube in an early stage, the illuminance on the screen is significantly decreased, and the color characteristics sometimes deteriorate.

Figure 11:
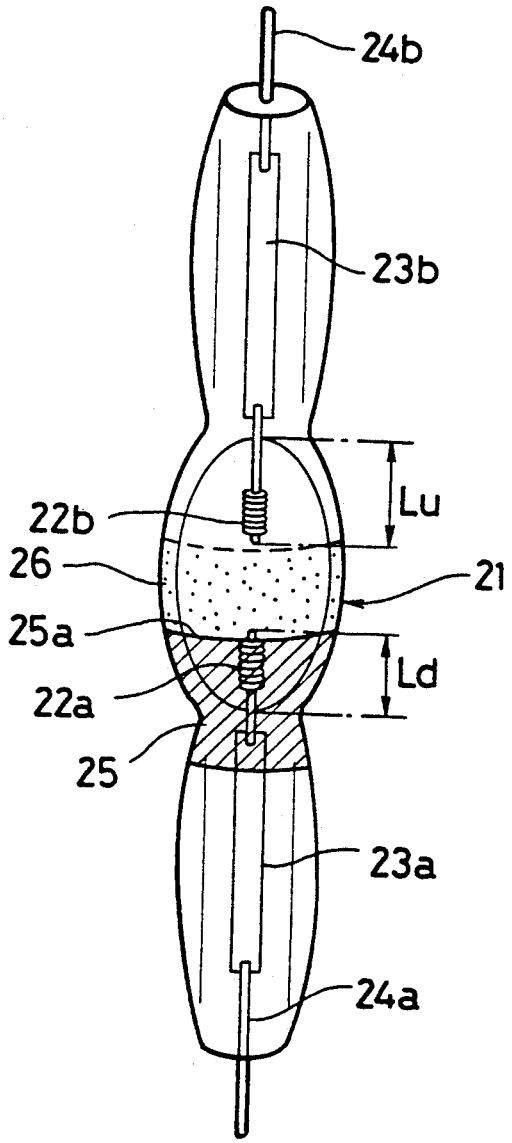
FIG. 11 is an enlarged side view showing a luminous tube in accordance with a second embodiment of the present invention.

A second embodiment is designed so that the life thereof is increased by suppressing the devitrification. FIG. 11 is a side view of the lamp portion of the second embodiment. In the drawing, reference numeral 21 denotes a luminous tube comprising a light-transmitting quartz container having a substantially elliptical cross-sectional form and a luminous portion at the center thereof. An upper electrode 22b is provided in an upper portion of the luminous tube 21, the upper electrode 22b having a closely wound coil which is formed by winding a tungsten wire having a diameter of 0.35 mm in a coil length of 2.5 mm on a tungsten core having a diameter of 0.5 mm and a length of 8.5 mm and which is disposed at a distance of 0.5 mm from the chip of the core. A lower electrode 22a which is the same as the upper electrode except that the length of the core is 6.5 mm is provided in a lower portion of the luminous tube 21.

In the present invention, the upper electrode 22b projects in a length of $L_u$ from the inner wall of the luminous tube, a ratio of the projection length $L_u$ to the projection length $L_d$ of the lower electrode 22a being set a value within the range of $1.2 \leqq L_u/L_d \leqq 1.8$ which is suitable for suppressing the devitrification. In this embodiment, $L_u$ is 6 mm, $L_d$ is 4 mm, and the ratio of $L_u/L_d$ is set of 1.5.

The electrodes 22a, 22b are connected to molybdenum foils 23a, 23b, respectively, for maintaining the electrical connection and airtightness of the quartz container. Molybdenum lead wires 24a, 24b are connected to the molybdenum foils 23a, 23b, respectively, so that electric power is supplied from both ends of the wires.

The luminous tube has a content volume of about 0.6 cc, the maximum outer diameter of 11 mm, the maximum inner diameter of 8.8 mm and an arc length of 5 mm, the total length of the luminous portion being longer than that of the luminous tube in the first embodiment. Dysprosium iodide, neodymium iodide and cesium iodide in an amount of 0.6 mg at a ratio by weight of 4:2:3 and mercury and argon are enclosed as luminous substances in the luminous tube 21. A reflecting-thermal insulating film 25 mainly composed of zirconium oxide is coated on a portion of the outer surface of the luminous tube in the vicinity of the lower electrode 22a.

A frost portion 26 is formed in the outer surface of the luminous tube 21 over the range from the edge 25a of the reflecting-thermal insulating film 25 to a position near the end of the upper electrode 22b in the same way as in the first embodiment.

Figure 12:
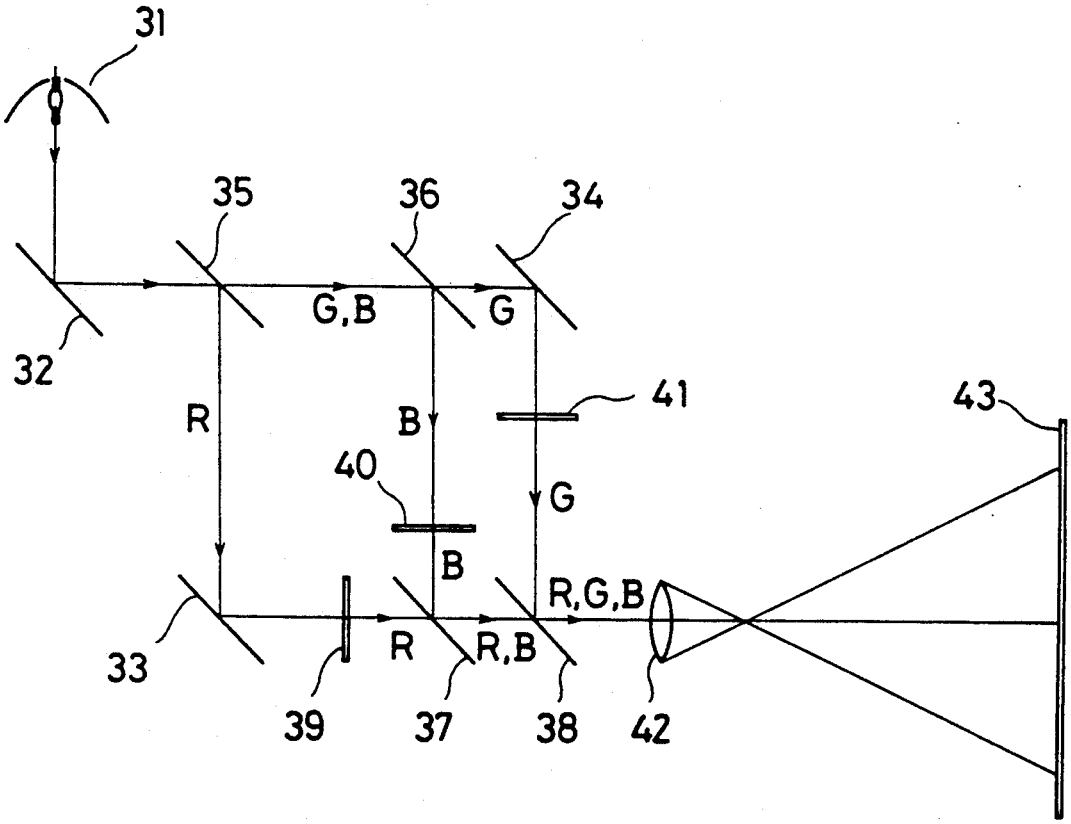
FIG. 12 is a schematic drawing showing an example of the arrangement of an overhead projection TV which uses the metal halide lamp apparatus shown in FIG. 11.

A parabolic reflecting mirror made of hard glass and having a cold mirror formed on the inner surface thereof and an outer diameter of 100 mm is provided on the luminous tube 21 configured as described above in the same way as in the first embodiment. The reflecting mirror is vertically disposed so that light is emitted from the open side of the reflecting mirror. For example, if a color filter and an image liquid crystal are optically disposed in front of the lamp so that light is projected by using a lens to form an overhead projection TV. FIG. 12 is a schematic drawing of the overhead projection TV. In the drawing, reference numeral 21 denotes a metal halide lamp apparatus according to this embodiment; reference numerals 32, 33, 34 denote total reflection mirrors; reference numerals 35, 36, 37, 38 denote color filters (dichroic mirror); reference numerals 39, 40, 41 denote transmission type image liquid crystals; reference numeral 42 denotes a projection lens; and reference numeral 43 denotes a screen.

When the metal halide lamp apparatus having the above arrangement is vertically disposed and switched on by an electronic blast with a rectangular wave of 270 Hz and rated lamp power of 150 W so that light is projected on the screen, the apparatus exhibits such excellent characteristics that the total luminous flux is 12,500 lm, the color temperature is 7000K., the color rendering index Ra is 85, the special color rendering index $R_9$ is 60, the average illuminance is 4100 lx and the illuminance ratio is 35%.

A description will now be given of the experiment performed for determining the above-described range of ratios of the projection length $L_u$ of the upper electrode 22b to the projection length $L_d$ of the lower electrode 22a in the luminous tube in the present invention.

A metal halide lamp apparatus was formed with the same arrangement as that of the second embodiment shown in FIG. 11 except that the projection length $L_u = 4$ mm of the upper electrode 22b was equal to the projection length $L_d$ of the lower electrode 22a, and the arc length was 7 mm. The metal halide lamp apparatus was used as a light source for an overhead projection TV. When the screen illuminance obtained after the lamp apparatus had been used for 500 hours was compared with the initial value, it was found that the average illuminance is reduced by half, and the central illuminance is reduced to half or less.

When the luminous tube was immediately discharged and examined, a cloudy portion caused by devitrification was observed in the luminous tube near the upper electrode 22b. It was found that since the light emitted from the central luminous portion to the devitrified portion does not effectively reach the reflecting mirror because the light is scattered by the devitrified portion, the screen illuminance is decreased, and the central illuminance is most decreased. It was also found that the remarkable devitrification in a portion of the inner surface of the quartz container which forms the luminous tube near the upper electrode 22b is caused by a significant increase in the temperature of the portion of the inner surface of the quartz container near the upper electrode 22b.

Experiment was thus made under the condition that the length $L_u$ of the portion of the upper electrode 22b projecting from the inner wall of the luminous tube was longer than the length $L_d$ of the projection portion of the lower electrode 22a in order to retard the occurrence of devitrification in an upper portion of the luminous tube which is effective to light emission. As a result, it was found that the rate of devitrification depends upon the lengths of the projecting portions. Namely, a luminous tube was formed with an arrangement in which the length of the core of the upper electrode 22b was 8.5 mm which was about 2 mm longer than that of the core of the lower electrode 22a in the same way as in the second embodiment, the projection length of the upper electrode 22b was 6 mm, and the arc length was 5 mm, with the quartz container having the same shape and dimensions. When the surface temperature of the luminous tube was examined with a rated electric power of 150 W, it was found that although the temperature of the central portion of the luminous tube was increased, the temperature of the portion near the upper electrode 22b was only slightly increased, substantially like the portion near the lower electrode, as compared with the lamp in which the projection length of the upper electrode is equal to that of the lower electrode.

When the luminous tube configured as described above was attached to a reflecting mirror for measuring illuminance, the central illuminance was increased by 20% as compared with the lamp in which the projection lengths of both electrodes are equal to each other, and the peripheral illuminance was substantially the same as that lamp. In addition, when illuminance was measured after the luminous tube formed had been used for 500 hours in a state where it was mounted in an optical device, the attenuation rate was 25% which was significantly improved as compared with the lamp in which the projection lengths of the upper and lower electrodes were the same.

Further, various luminous tubes having upper electrodes having different projection lengths $L_u$ were formed and used for experiment. As a result, it was found that if the projection length $L_u$ of the upper electrode 22b is less than a value of 1.2 times the projection length $L_d$ of the lower electrode 22a, there is substantially no effect. It was also found that if the projection length $L_u$ exceeds a value of 1.8 times the projection length $L_d$, a desired vapor pressure cannot be obtained, the color and luminous distribution deteriorate, and the usable lamp state cannot be obtained.

In the present invention, the ratio of the projection length $L_u$ of the upper electrode to the projection length $L_d$ of the lower electrode is therefore set to a value within the range of $1.2 \leqq L_u/L_d \leqq 1.8$. When the ratio is set within the range, the luminous tube sufficiently maintains illuminance and can be used as a light source having characteristics which have no problem for practical use even if the luminous tube has a longer shape and an arc length, for example, 7.5 mm.

In the second embodiment shown in FIG. 11, the illuminance ratio to the ratio 1/L of the frost portion in the outer surface of the lamp and the screen average illuminance were measured by the same method as that in the first embodiment. As a result, a plot curve showing the same tendency as that shown in FIG. 10 was obtained.

Namely, when the ratio 1/L is defined to the range from 25% to 70%, a bright screen having a high screen average illuminance, a high illuminance ratio and low irregularity in illuminance is obtained, and good optical characteristics are thus obtained.

What is claimed is:

1. A metal halide lamp apparatus comprising:

a reflecting mirror having a parabolic or ellipsoidal reflecting surface provided with an open side and a bottom side;

a metal halide lamp provided with a first electrode placed on the open side of said reflecting mirror and a second electrode placed on the bottom side of said reflecting mirror, said metal halide lamp being disposed in front of said reflecting mirror so that an axis connecting both of said electrodes substantially lies on an axis of said reflecting mirror, said metal halide lamp comprising a luminous tube;

a reflecting-thermal insulating film formed on a portion of an outer surface of the metal halide lamp in the vicinity of said first electrode placed on the open side of said reflecting mirror; and a frost portion formed in a portion of the lamp outer surface which has one end at an edge of the reflecting-thermal insulating film and the other end ranging from a position near a center point between both of said electrodes to a position near a center point of a coil of said second electrode placed on the bottom side of the reflecting mirror.

2. A metal halide lamp apparatus according to claim 1, wherein when the length from the edge of said reflecting-thermal insulating film formed on the outer surface of said metal halide lamp to an end of the inner wall adjacent to said upper electrode of said luminous tube on the bottom side of said reflecting mirror is L, and the length from the edge of said reflecting-thermal insulating film to the end of said frost portion is 1, a ratio of 1/L is set to a value within the range of 0.25 to 0.7.

3. A metal halide lamp apparatus according to claim 2, wherein at least dysprosium halide is enclosed in said metal halide lamp.

4. A metal halide lamp apparatus according to claim 1, wherein at least dysprosium halide is enclosed in said metal halide lamp.

5. A metal halide lamp apparatus comprising:

a reflecting mirror having a parabolic or ellipsoidal reflecting surface provided with an open side and a bottom side;

a metal halide lamp provided with a lower electrode placed on the open side of said reflecting mirror and an upper electrode placed on the bottom side of said reflecting mirror, said metal halide lamp being disposed in front of said reflecting mirror so that an axis connecting both of said electrodes substantially lies on an axis of said reflecting mirror, the axis of said metal halide lamp being vertically disposed during use, said metal halide lamp comprising a luminous tube;

a reflecting-thermal insulating film formed on a portion of an outer surface of the metal halide lamp in the vicinity of said electrode placed on the open side of said reflecting mirror; and a frost portion formed in a portion of the lamp outer surface which has one end at an edge of the reflecting-thermal insulating film and the other end ranging from a position near a center point between both of said electrodes to a position near a center point of a coil of said upper electrode placed on the bottom side of the reflecting mirror;

a length $L_u$ being defined as a portion of the upper electrode projecting from an inside wall of the luminous tube and a length $L_d$ being defined as a portion of the lower electrode projecting from the inside wall of the luminous tube, wherein a ratio of $L_u$ to $L_d$ is $1.2 \leqq L_u/L_d \leqq 1.8$.

6. A metal halide lamp apparatus according to claim 5, wherein when the length from the edge of said reflecting-thermal insulating film formed on the outer surface of said metal halide lamp to an end of the inner wall adjacent to said second electrode of said luminous tube on the bottom side of said reflecting mirror is L, and the length from the edge of said reflecting-thermal insulating film to the end of said frost portion is 1, a ratio of 1/L is set to a value within the range of 0.25 to 0.7.

7. A metal halide lamp apparatus according to claim 6, wherein at least dysprosium halide is enclosed in said metal halide lamp.

8. A metal halide lamp apparatus according to claim 5, wherein at least dysprosium halide is enclosed in said metal halide lamp.

* * * * *